United States Patent [19]

Conti

[11] 3,958,309

[45] May 25, 1976

[54] MOTORIZED EXPANDER FOR ONE, TWO OR MORE CLOTH WIDTH

[76] Inventor: Fulvio Conti, Via Carnovali, 88, 24100 Bergamo, Italy

[22] Filed: Aug. 7, 1974

[21] Appl. No.: 495,499

[30] Foreign Application Priority Data

Sept. 27, 1973 Italy ..... 29472/73

[52] U.S. Cl. ..... 26/105

[51] Int. Cl.[2] ..... D06C 3/06

[58] Field of Search ..... 26/63–67; 139/292

[56] References Cited

UNITED STATES PATENTS

| | | | |
|---|---|---|---|
| 2,042,010 | 5/1936 | Lewis | 26/63 |
| 2,925,640 | 2/1960 | Morrow | 26/63 |
| 3,509,607 | 5/1970 | Fleissner | 26/65 X |

*Primary Examiner*—Louis K. Rimrodt

*Attorney, Agent, or Firm*—Browdy and Neimark

[57] ABSTRACT

Motorized expander comprising on a single driven shaft at least two cylinders rigid with the shaft at its ends, a central cylinder idly mounted between the cylinders and separated from them by free spaces, and at least one clutch member for transmitting rotary motion to the central cylinder situated in one of the free spaces. The central cylinder is provided on its surface with a pair of opposite handed spirals, and each of the two cylinders comprises a spiral opposite handed to that of the adjacent spiral of the central cylinder. The spirals are arranged together to define a stretching device for one or more fabrics of normal width when the central cylinder rotates rigidly with the shaft, or a stretching device for a fabric of double or multiple width when the central cylinder is provided with motion relative to the shaft.

3 Claims, 3 Drawing Figures

1
2
3
4
5
6
7
8
9
10
11
12
13
13a
14
14a
15
16
17
18
19
20

MOTORIZED EXPANDER FOR ONE, TWO OR MORE CLOTH WIDTH

BACKGROUND OF THE INVENTION

This invention relates to a motorized expander for one, two or more cloth widths, usable on all types of fabric.

Expanders are commonly used industrially, being devices inserted in the manufacturing line for fabrics in order to stretch them in the direction of their width, so as to prevent their shrinkage or the curling of the selvedges.

Known expanders are of the rotating curved type, the double opposite fixed spiral type or the motorized spiral type. These expanders have common disadvantages, the most important of which is represented by the complicated operations which have to be carried out on the expander when a fabric of a width different from the width of the previously worked fabric is to be stretched. For example, in the case of rotating curved expanders or double opposite fixed spiral expanders, in which differently wide fabrics are worked on different surfaces of the device, said operations involve overturning of the respective device so as to introduce the appropriate surface into the fabric path (in fixed expanders) or changing the cloth threading of a processing line (in rotating curved expanders). Both these operations create downtimes in production, with obvious repercussions on the economy of the process.

A further disadvantage encountered in known types of expander is their limited applicability to certain types of textile materials. For example, opposite fixed spiral expanders are suitable for processing woven fabrics, but cannot be effectively applied to knitted fabrics.

A further disadvantage in the case of rotating curved expanders is their large overall dimensions.

SUMMARY OF THE INVENTION

An object of the present invention is to obviate the aforementioned disadvantages, by providing a motorized expander which permits easy and rapid adaptation, for working one, two or multi-width fabrics practically without downtime, so correspondingly reducing production costs.

A further object of the invention is to provide an expander which ensures absolute effectiveness in unrolling the selvedges of any type of fabric.

A further object of the invention is to provide a motorized expander of the aforementioned type which can be used for fabrics of different widths, within wide limits.

These and still further objects are attained by a motorised expander according to the invention, comprising on a single driven shaft at least two cylinders rigid with said shaft at its ends, a central cylinder idly mounted between said two cylinders and separated from them by free spaces, and at least one clutch member for transmitting rotary motion to said central cylinder situated in one of said free spaces, said central cylinder being provided on its surface with a pair of opposite handed spirals, and each of said two cylinders comprising a spiral opposite handed to that of the respective adjacent spiral of said cylinder, said spirals being arranged to define a stretching device for one or more fabrics of normal widths when said central cylinder rotates rigidly with said shaft, or a stretching device for a fabric having a double or multiple width when said central cylinder is provided with motion relative to said shaft.

BRIEF DESCRIPTION OF THE DRAWINGS

Further characteristics and advantages of the invention will be more evident from the description of a preferred but not exclusive embodiment of a motorized expander, illustrated by way of non-limiting example in the accompanying drawing in which.

DESCRIPTION OF PREFERRED EMBODIMENTS

Figures 1, 2, 3:
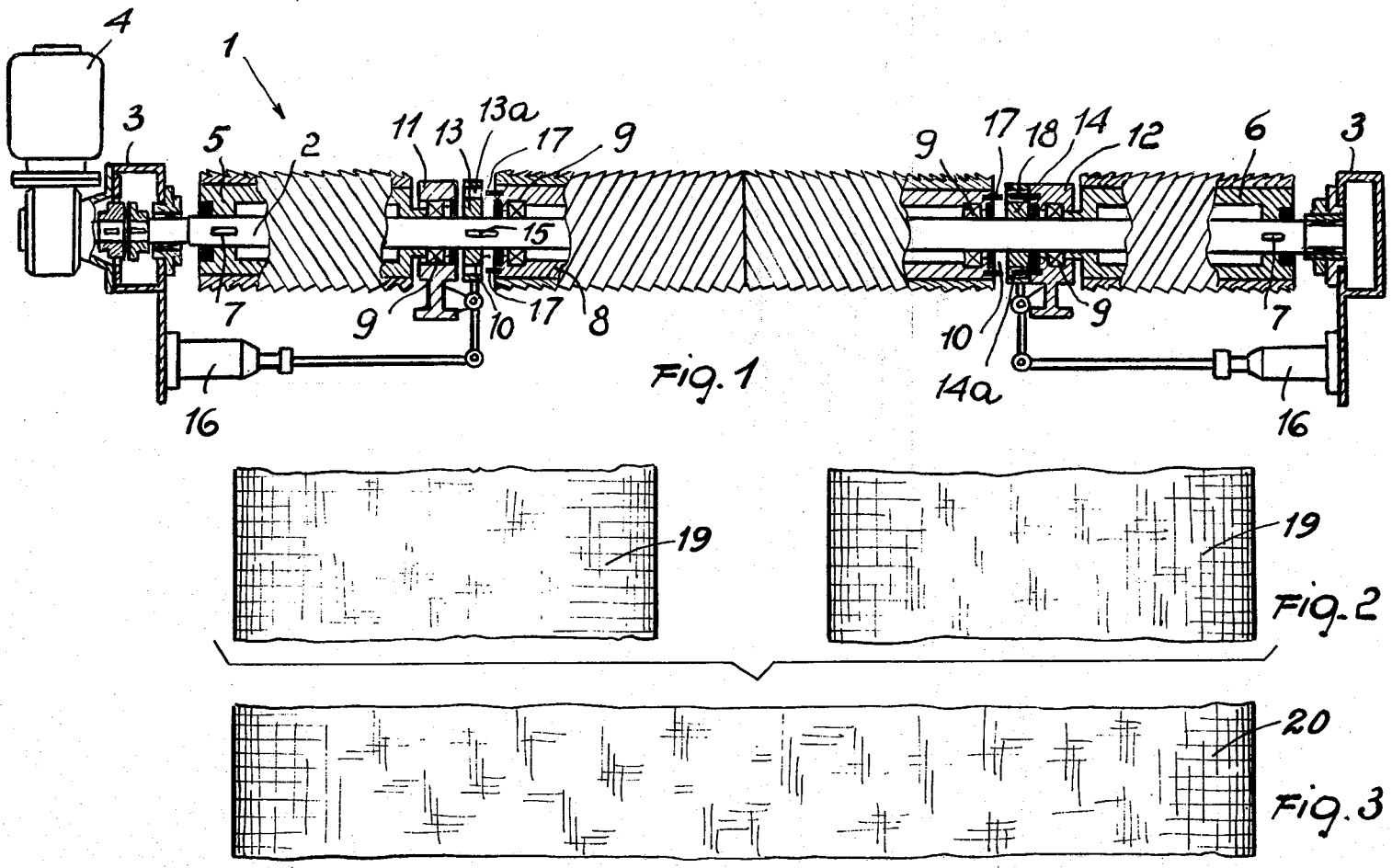
FIG. 1 is a lateral view of an expander according to the invention partially sectioned axially.
FIGS. 2 and 3 show how processing of two normal width fabrics and processing of a double width fabric, respectively, occurs on the expander according to the invention.

With reference to the aforementioned figures, the motorized expander 1 according to the invention comprises a driven shaft 2 mounted in a frame 3 and driven by a motor 4. On the ends of the shaft 2 are mounted a first and second cylinder, 5 and 6 respectively, made rigid with the shaft by conventional means, such as keys 7.

A central further cylinder 8 is idly mounted on the shaft between the two spaced cylinders 5 and 6, by way of bearings 9. The cylinder 8 is spaced apart from the cylinders 5 and 6, to define suitable free spaces 10 between its ends and the facing ends of the respective cylinders 5 and 6. In the free spaces 10 there are intermediate support members 11 and 12 for limiting excessive bending of the shaft 2. The supports 11 and 12 are nonremovable and support the shaft 2 by way of bearings 9. In the spaces 10 between the intermediate supports 11, 12 and the respective end of the roller 8, there are also a clutch for transmitting the rotary motion from the shaft 2 to the cylinder 8, and possibly means for locking the cylinder 8. The clutch comprises a disc 13 and conventional means 15 for connecting said disc on to the shaft 2 to make it rigid with it for rotation and to allow axial displacement of the disc 13 on the shaft 2. The clutch is activated and disactivated by corresponding means including a pushbutton, and a pneumatic device 16 connected to said disc 13 by way of bearings (not shown), to enable rotation of the disc. Activation of the clutch causes axial movement of the disc 13 on the shaft 2 over a short distance defined by the configuration of means 15, and is sufficient to permit the engagement of the disc 13 with the central cylinder 8, or its disengagement from it. For this purpose, on the disc 13 there is provided at least one notch **13*a* extending substantially parallel to the axis of the disc and arranged to receive a corresponding tooth projecting from the respective end of the cylinder 8 for rotationally driving the cylinder 8.**

The locking means comprises a disc 14 idly mounted on the shaft 2 between the stationary support 12 and the cylinder 8, said disc having at least one through hole **14*a* in permanent engagement with a corresponding pin 18 projecting from the stationary support 12 in a direction substantially parallel to the axis of the shaft 2, the pin being arranged to lock said disc 14 during the rotation of the drive shaft 2. The disc 14 can move axially on the shaft 2 by means of a pneumatic control 16. In this case axial displacement takes place over a short distance sufficient to allow the engagement of the through hole or holes 14*a* with a corresponding pin 17 projecting from the respective end of the cylinder 8,** while maintaining engagement with the pin or pins 18 since the distance between two aligned pins 17 and 18 is smaller than the thickness of the disc 14. In this manner the cylinder 8 is locked and remains constrained to the stationary support 12.

The central cylinder 8 is provided on its laterial surface with a pair of opposite handed spirals. The lateral surfaces of the cylinders 5 and 6 are also spirralled, each of the spirals being opposite handed with respect to the respective adjacent spiral of the further cylinder 8.

The operation of the motorized expander according to the invention is as follows. For the processing of two normal width fabrics, the cylinder 8 is rotated, by means of the clutch member 13, in addition to the cylinders 5 and 6, and the two pieces of fabric 19 are arranged as shown in FIG. 2. The direction of rotation of the shaft 2 is chosen according to the hand of the spirals and the feed direction of the fabric. It is preferable to have an arrangement such that expansion of the fabric occurs when the shaft 2 is rotated in a direction opposite the feed direction of the fabric, which enables a greater widening force to be obtained.

The processing of one single normal width fabric is effected on the central cylinder 8. In this case said cylinder is rotated rigidly with the shaft 2 by means of the clutch member 13, and is rotated in a direction opposite to that used in the case of two normal width fabrics because of the opposite arrangement of the spirals of cylinder 8 with respect to those of cylinders 5 and 6.

For the processing of one double width fabric 20 (as shown in FIG. 3), the cylinders 5 and 6 are rotated in a direction causing stratching of the fabric, while the idly mounted central cylinder 8 is disengaged from shaft 2. The cylinder is rotated by the fabric itself in its feed direction, and because of the direction of development of its turns, the cylinder 8 produces a supplementary widening effect on the central parts of the fabric.

In certain cases of processing double width fabrics, it may be desiderable to reduce the widening effect exerted by the central cylinder on the central parts of the fabric. In this case the central cylinder 8 is locked by the locking means 14, and the cylinders 5 and 6 are simultaneously rotated in the to direction causing stretching of the fabric.

From the description it can be seen that the expander 1 according to the invention attains the set objects by allowing rapid adaptation for processing differently wide fabrics, by a device of simple conception and easy construction.

The invention so conceived is susceptible to numerous modifications all of which fall within the scope of the inventive idea. For example by mounting a number of elements of the aforementioned type on the same drive shaft, a number of processing widths greater than two can be formed, as will be evident to experts of the art.

Furthermore all details may be replaced by other technically equivalent elements.

I claim:

1. A motorized expander comprising a drive shaft, at least two cylinders arranged on said shaft, said two cylinders being fixedly connected to said shaft for rotation therewith and being spaced from one another, a further cylinder idly mounted on said shaft between each of said at least two cylinders and spaced therefrom, a clutch, arranged in at least one of the spaces defined between each of said at least two cylinders and said further cylinder, for transmitting rotary motion from said shaft to said further cylinder, said further cylinder having a spiralled surface with a pair of opposite handed spirals thereon and each of said at least two cylinders having a spiralled surface with a single spiral opposite handed to the respective adjacent spiral of said further cylinder, and activating means for activating said clutch to cause said further cylinder to rotate with said at least two cylinders, thereby defining an expander suitable for one or more fabrics of normal width, and for disactivating said clutch to cause said further cylinder to rotate relative to said shaft and said at least two cylinders, thereby defining an expander suitable for a fabric having a multiple width.

2. A motorized expander as claimed in claim 1, wherein said clutch comprises a disc axially slidable on said shaft and rotatable therewith, said disc having at least one notch extending substantially parallel to the axis of said disc, wherein said further cylinder has at least one tooth projecting therefrom for engaging said at least one notch, and wherein said activator means includes means for axially displacing said disc and causing said at least one tooth to engage said at least one notch for transmitting rotary motion from said shaft to said further cylinder.

3. A motorized expander as claimed in claim 1, further comprising locking means for locking said further cylinder against rotation during rotation of said shaft, said locking means comprising a stationary support for said shaft arranged between one of said at least two cylinders and said further cylinder, a disc idly mounted on said shaft between said support and said further cylinder and axially slidable on said shaft and means for axially displacing said disc, and wherein said further cylinder and said support each include at least one pin projecting substantially parallel to the axis of the said shaft, said pins being spaced, when in alignment, by an extent smaller than the thickness of said disc, said disc having at least one through hole for receiving said pin projecting from said stationary support and being axially movable between a position in which said through hole receives only said pin of said stationary support, thereby allowing rotation of said further cylinder, and a position in which said through hole receives both the pin of said stationary support and the pin of said further cylinder, thereby locking said further cylinder against rotation.

* * * * *